United States Patent [19]

Valo

[11] 4,074,738

[45] Feb. 21, 1978

[54] ARRANGEMENT FOR A ROTOR BARKING MACHINE

[76] Inventor: Veikko Lennart Valo, Hiidensalmi, 08100 Lohja 10, Finland

[21] Appl. No.: 780,152

[22] Filed: Mar. 22, 1977

[30] Foreign Application Priority Data

Apr. 2, 1976 Finland ..... 760896

[51] Int. Cl.[2] ..... B27L 1/00

[52] U.S. Cl. ..... 144/208 E

[58] Field of Search ..... 144/208 E, 208 R

[56] References Cited

U.S. PATENT DOCUMENTS 2,788,034 4/1957 Brundell et al. ..... 144/208 E 2,860,672 11/1958 Brundell et al. ..... 144/208 E

FOREIGN PATENT DOCUMENTS 187,989 10/1966 U.S.S.R. ..... 144/208 E

*Primary Examiner*—Donald R. Schran

*Attorney, Agent, or Firm*—Ladas, Parry, Von Gehr, Goldsmith & Deschamps

[57] ABSTRACT

Arrangement for a rotor barking machine comprising a hollow rotor rotatably mounted in a frame and provided with barking arms directed towards the center of the rotor and means for feeding a tree to be barked longitudinally through the hollow rotor. A non-rotating tubular portion is provided in the opening of the hollow motor to extend from the inside of said opening close to the plane of rotation of the barking members. The annular edge of the tubular member adjacent said barking members is provided with cutting teeth. The cutting teeth tear and cut in co-operation with said barking members bark strips sticking to said barking members.

3 Claims, 2 Drawing Figures

ARRANGEMENT FOR A ROTOR BARKING MACHINE

Figure 1:
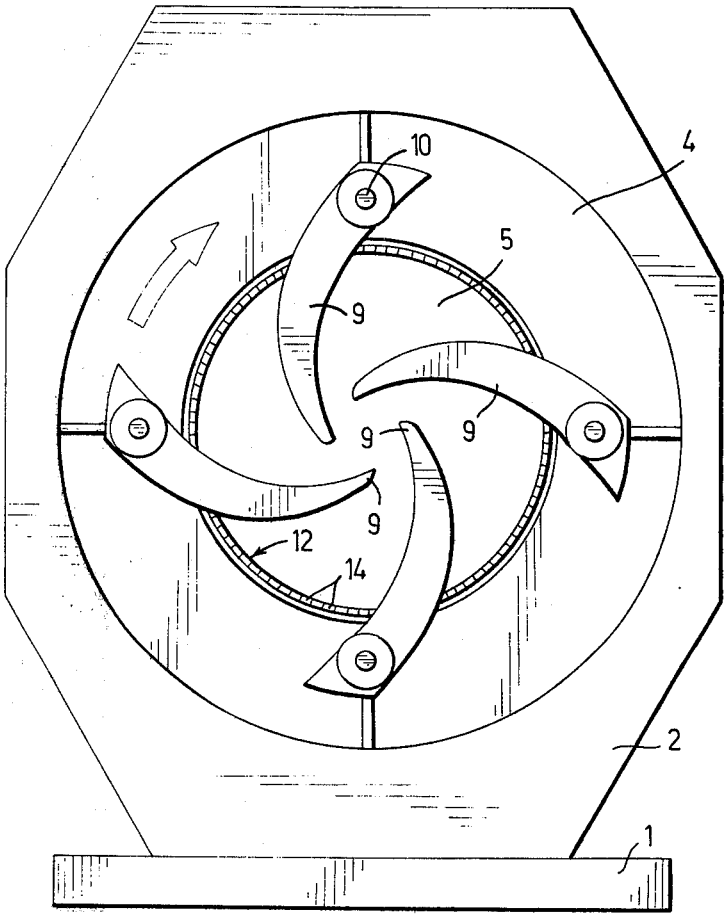

The present invention relates to an arrangement for a rotor barking maching comprising a hollow rotor rotatably mounted in a frame, barking members pivotally journalled on the discharge side of the rotor and directed toward the centre of the rotor, cutting members supported by the frame and extending close to the plane of rotation of the barking members for cutting-off of bark strips, and means for feeding a tree to be barked longitudnally through the hollow rotor.

When barking a tree with long-fibred bark, such as an eucalyptus tree, and a tree soaked by water, bark coming off in long strips causes difficulties because the bark strips have a tendency to stick to the neck portions and bearing shafts of the barking arms and to accumulate tightly in the opening of the rotary hollow rotor under the influence of the centrifugal force.

To loosen bark strips which have become stuck it is previously known to pivotally journal in a machine frame one or several serrated knives pivotable by hydraulic cylinders toward the center of the hollow rotor adjacent to the barking arms. The serrated knives thereby cut off the bark strips wound around the barking arms to allow the bark strips to be slung off. Such a construction, however, suffers from the disadvantage that the serrated knives must always be pivoted out of the way of the next tree trunk because the knives in the operating position extend radially with respect of the opening of the hollow rotor toward the centre thereof. This calls for a spacial pivoting mechanism for each knife. Such a knife construction also offers no solution to the problem that long bark strips under the influence of the centrifugal force tend to stick to the rotating inner wall of the opening in the hollow rotor. The use of scrapers to remove the bark strips is hampered by the fact that the centrifugal force presses the bark strips very tightly against the rotary wall.

U.S. Pat. No. 2,788,034 describes a hollow rotor barking machine of the above specified kind provided with fixed radial racks supported by the machine frame and positioned outside the opening of the hollow rotor close to the plane of rotation of the barking arms. Due to this kind of structure, there is no way of applying any cutting or preventive action on long bark strips which inevitably get inside the opening in the hollow rotor, but they are freely allowed to wind themselves around the bearing housings of the barking arms thereby causing breakdowns in the rotor. This structure also suffers from the above mentioned disadvantage associated with the tight accumulation of bark strips on the rotating inner wall of the opening in the rotor due to the centrifugal force.

It is the object of this invention to provide an arrangement which not only allows the cutting-off and removal of bark strips stuck on the barking arms by fixed means, but also solves the problem caused hitherto by bark strips getting into the opening of the hollow rotor by preventing the bark strips from getting into contact with the bearing housings of the barking arms and by collecting such bark strips on a non-rotating surface which is thereby uneffected by the centrifugal force. This object is accomplished by means of the arrangement according to the invention which is characterized by a non-rotating tubular portion extending into the opening of the hollow rotor, the end edge of the mantle of said portion extending from the inside of the opening in the hollow rotor close to the plane of rotation of the barking means and being either shaped as cutting members or provided therewith.

According to the invention, there is provided an arrangement wherein the loosening and removal of bark strips is accomplished without any moving parts from the inside of the opening in the hollow rotor and not from the outside of the opening as in known devices. The end edge provided with cutting members of the cylindrical mantle located in the opening of the hollow rotor extends from the inside of the opening in the hollow rotor adjacent to the plane of rotation of the barking arms so that long bark strips eventually sticking to the barking arms and sliding along them toward the outer ends of the arms are efficiently cut off and slashed to pieces when the bark strips get into the slot between the end edge of the mantle and the barking arms whereby the pieces of bark strip are slung off from the barking arms. The cylindrical mantle in the opening of the hollow rotor does not at all extend to the path of movement of the log to be barked. The cylindrical mantle has, moreover, the marked advantage of forming in the opening of the hollow rotor a non-rotating wall covering the rotating parts of the rotor and the bearing housings of the barking arms. Due to this, bark strips and pieces eventually getting into the opening of the hollow rotor can also not stick to other parts in the rotor, but will accumulate upon the non-rotating wall and, accordingly, will not any more be subjected to the centrifugal force. The bark accumulations can therefore be easily removed from the opening of the hollow rotor when pushed by the next log to be fed through the rotor or, for example, with a simple sweeping arm if they do not themselves fall out of the opening due to the vibration of the machine.

Figure 2:
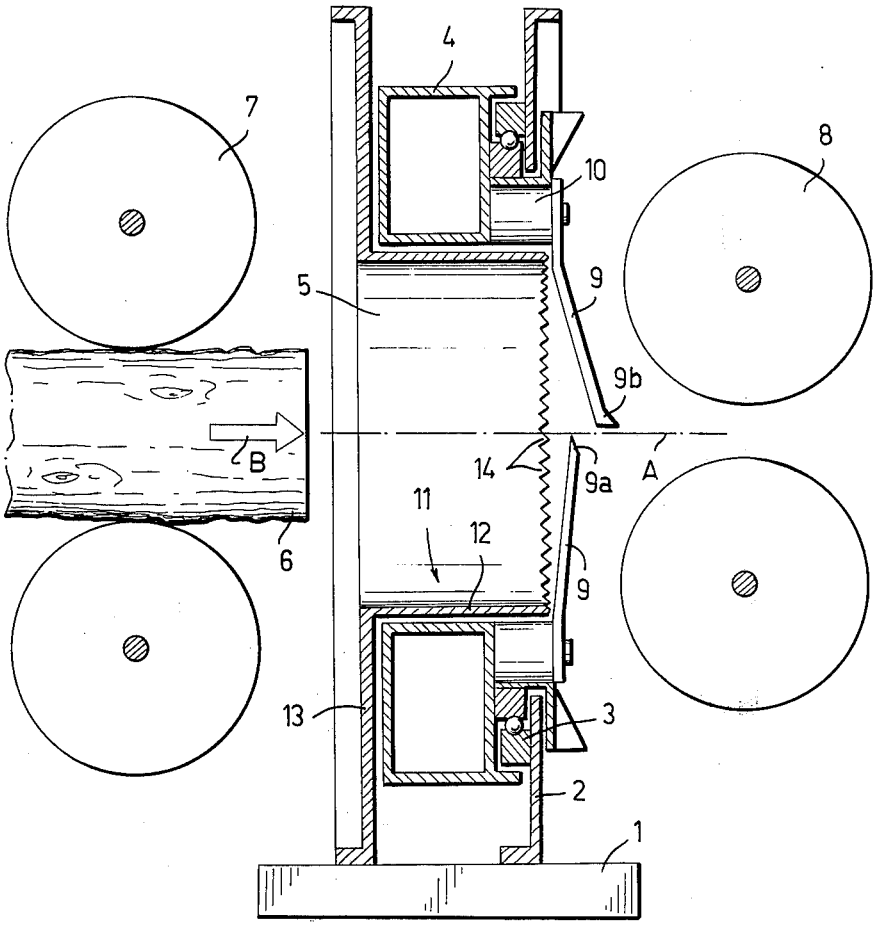

The invention will now be described in more detail in the following with reference to the accompanying drawing, wherein FIG. 1 is a schematic view from the discharge and of a barking machine embodying the invention, and FIG. 2 is a vertical axial section of the barking machine.

The barking machine shown in the drawing comprises an annular frame 2 supported by a base 1, a hollow rotor 4 being rotatably journalled with bearings 3 in said frame to rotate around a horizontal axis of rotation A. The hollow rotor forms a central through opening 5 for a tree trunk 6 to be barked, the direction of movement whereof is marked with arrow B. The barking machine further includes feed rolls 7, 8 which grip the trunk.

On the discharge side of the hollow rotor 4, barking arms 9 are pivotally journalled by means of bearings 10 in the rotor, the axes of rotation of said arms being parallel to that of the rotor. In the embodiment shown, every second barking arm is provided with a cutting blade **9*a* and the other arms with barking blade 9*b*** whereby the cutting blades are located at an axial distance in front of the barking blades in the direction of motion of the tree trunk so that the cutting blades first cut up the bark and the barking blades thereafter bark off the helical bark strips thus cut up.

The barking machine is according to the invention provided with a cutting member for cutting-off of bark strips stuck to the barking arms. The cutting member consists of a cylindrical mantle 12 located in the opening of the hollow rotor, said mantle on the inlet side of the rotor being supported on the base 1 through a supporting plate 13 so as to form a non-rotatable structure together with the trunk 2. At the discharge end, the end edge of the cylindrical mantle extends close to the plane of rotation of the barking arms 9 so as to leave only a narrow slot between said end edge and the barking arms. This end edge is provided with cutting teeth 14.

It will be noted that long bark strips coming off the trunk to be barked and sticking to the barking arms and sliding under the influence of the centrifugal force toward their outer ends get at the neck portions of the barking arms into contact with the cutting teeth of the non-rotating mantle, said teeth tearing and cutting the bark strips into pieces and off the barking arms. It will also be noted that the bark strip getting into the opening cannot stick to the rotating parts of the rotor nor to the bearing houses of the barking arms. The bark getting to the inner surface of the cylindrical mantle is not subjected to to the centrifugal force and can therefore without difficulty fall out of the opening.

The drawing and the accompanying specification are only intended to illustrate the idea of the invention. In its details the arrangement according to the invention may vary considerably within the scope of the claims.

What I claim is:

1. An arrangement for a rotor barking machine comprising a hollow rotor rotatably mounted in a frame, barking members pivotally journalled on the rotor and directed toward the centre of a rotor, a cutting member supported by the frame and extending close to the plane of rotation of the barking members for cutting-off of back strips, and means for feeding a tree to be barked longitudinally through the hollow rotor, said cutting member comprising a non-rotating tubular portion extending into the opening in the hollow rotor, the end edge of said portion extending from the inside of the opening in the hollow rotor close to the plane of rotation of the barking members and being formed with cutting means.

2. An arrangement as claimed in claim 1, wherein the tubular portion extends from the inlet side of the hollow rotor into the opening in the hollow rotor.

3. An arrangement as claimed in claim 1, wherein the end edge of the tubular portion is provided with cutting teeth.

* * * * *